US012215575B2

(12) United States Patent
Badeghaish et al.

(10) Patent No.: US 12,215,575 B2
(45) Date of Patent: Feb. 4, 2025

(54) WELL CONDUIT LINING METHOD AND SYSTEM

(71) Applicant: SAUDI ARABIAN OIL COMPANY, Dhahran (SA)

(72) Inventors: Wael O. Badeghaish, Dhahran (SA); Mohamed Nabil Noui-Mehidi, Dhahran (SA); Abdulrahman Abdulaziz Al Mulhem, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/355,863

(22) Filed: Jul. 20, 2023

(65) Prior Publication Data

US 2023/0358121 A1 Nov. 9, 2023

Related U.S. Application Data

(63) Continuation-in-part of application No. 16/822,659, filed on Mar. 18, 2020, now abandoned.

(51) Int. Cl.
*E21B 43/10* (2006.01)
*E21B 23/00* (2006.01)
(Continued)

(52) U.S. Cl.
CPC ..... *E21B 43/103* (2013.01); *E21B 23/001* (2020.05); *E21B 43/08* (2013.01);
(Continued)

(58) Field of Classification Search
CPC ..... E21B 43/103; E21B 23/001; E21B 43/08; E21B 43/108; E21B 47/00; E21B 47/10; E21B 23/14
See application file for complete search history.

(56) References Cited

U.S. PATENT DOCUMENTS 4,867,243 A * 9/1989 Garner ..... E21B 33/068 166/77.4
6,024,910 A * 2/2000 Kamiyama ..... F16L 55/1654 264/269

(Continued)

*Primary Examiner* — Tara Schimpf
*Assistant Examiner* — Neel Girish Patel
(74) *Attorney, Agent, or Firm* — Osha Bergman Watanabe & Burton LLP

(57) ABSTRACT

A method includes assembling a liner system by disposing a fiber optic cable circumferentially around an inner tube liner and locating an outer tube liner around the inner tube liner. The fiber optic cable is located between the inner tube liner and the outer tube liner. The method also includes spooling out the liner system, in a lay-flat state, into a conduit of a tubular structure positioned in the well, terminating spooling out the liner system when a select length of the liner system has been deployed in the conduit of the tubular structure, and securing the select length of the liner system deployed into the tubular structure at a surface above the well. The method further includes injecting a fluid into the inner tube liner of the liner system to radially expand the liner system to conform an outer circumferential surface of the outer tube liner to an inner circumferential surface of the tubular structure, protecting the inner circumferential surface of the tubular structure using the liner system, and measuring a property of the well using the fiber optic cable.

20 Claims, 13 Drawing Sheets

(51) Int. Cl.
*E21B 23/14* (2006.01)
*E21B 43/08* (2006.01)
*E21B 47/00* (2012.01)
*E21B 47/10* (2012.01)

(52) U.S. Cl.
CPC ..... *E21B 43/108* (2013.01); *E21B 47/00* (2013.01); *E21B 47/10* (2013.01); *E21B 23/14* (2013.01)

(56) References Cited

U.S. PATENT DOCUMENTS 6,431,271 B1 * 8/2002 Thomeer ..... E21B 41/0042 166/207
6,772,840 B2 * 8/2004 Headworth ..... E21B 17/18 166/57
7,281,422 B2 * 10/2007 Keller ..... E21B 43/103 166/250.03
8,973,434 B2 * 3/2015 Albrecht ..... E21B 47/01 73/152.57
11,641,050 B2 * 5/2023 Daton-Lovett ..... H01Q 1/087 343/874
2002/0157720 A1 * 10/2002 Quigley ..... E21B 17/20 138/144
2003/0056954 A1 * 3/2003 Headworth ..... E21B 17/18 166/57
2003/0106688 A1 * 6/2003 Saugier ..... E21B 7/208 175/320
2005/0023002 A1 * 2/2005 Zamora ..... D04C 1/06 166/380
2005/0172710 A1 * 8/2005 Keller ..... E21B 43/103 73/152.41
2006/0071158 A1 * 4/2006 Van Der Spek ..... E21B 47/01 250/227.14
2006/0115335 A1 * 6/2006 Allen ..... E21B 47/001 405/274
2007/0187103 A1 * 8/2007 Crichlow ..... E21B 43/2408 166/302
2007/0284107 A1 * 12/2007 Crichlow ..... E21B 43/305 166/387
2008/0271926 A1 * 11/2008 Coronado ..... E21B 17/026 175/325.1
2010/0058828 A1 * 3/2010 Hallundbaek ..... E21B 29/10 137/15.08
2010/0154187 A1 * 6/2010 Kamiyama ..... F16L 55/1656 29/402.16
2011/0017468 A1 * 1/2011 Birch ..... E21B 43/103 166/369
2011/0247698 A1 * 10/2011 Karabelas ..... F16L 11/083 137/13
2011/0265989 A1 * 11/2011 Alexandersson ..... F24T 10/10 166/208
2012/0018149 A1 * 1/2012 Fidan ..... G01V 8/16 166/250.03
2012/0143521 A1 * 6/2012 Chen ..... G01B 11/18 702/42
2013/0160999 A1 * 6/2013 Hallundbæk ..... E21B 43/103 166/53
2013/0199794 A1 * 8/2013 Lane ..... E21B 34/00 166/372
2013/0327138 A1 * 12/2013 Richard ..... E21B 47/12 73/152.54
2015/0128692 A1 * 5/2015 Chen ..... E21B 47/103 73/152.18
2015/0167416 A1 * 6/2015 Ludwig ..... E21B 4/006 166/385
2015/0267474 A1 * 9/2015 Kriesels ..... E21B 7/20 175/45
2016/0177697 A1 * 6/2016 Looijer ..... E21B 43/20 166/266
2016/0362968 A1 * 12/2016 Kriesels ..... E21B 43/108
2018/0223648 A1 * 8/2018 Wilson ..... G01V 3/30
2018/0347307 A1 * 12/2018 Gabriele ..... C08L 67/00
2019/0064387 A1 * 2/2019 Ohanian, III ..... G01N 21/47
2019/0257156 A1 * 8/2019 Batarseh ..... B23K 26/38
2020/0003030 A1 * 1/2020 Bakulin ..... E21B 47/017
2020/0232292 A1 * 7/2020 Keller ..... E21B 43/105
2020/0248548 A1 * 8/2020 Al-Mulhem ..... H02G 11/02
2021/0123319 A1 * 4/2021 Greci ..... E21B 33/1208
2023/0025615 A1 * 1/2023 Zemla ..... E21B 23/08
2024/0141777 A1 * 5/2024 Alerigi ..... E21B 47/098

* cited by examiner

WELL CONDUIT LINING METHOD AND SYSTEM

FIELD

The disclosure relates generally to a method and a system for protecting well tubulars from corrosive fluids downhole.

BACKGROUND

Tubulars are installed in wells to provide a conduit from the well to the surface and to support the wall of the well. However, once the well starts producing water, corrosion of these tubulars becomes a concern. In order to prevent corrosion of well tubulars, several methods are used, such as injecting chemical inhibitors into the well, lining the tubulars with protective coatings, and lining the tubulars with high grade alloys such as chromium or nickel based alloys. However, these methods are either inefficient or relatively expensive in terms of cost and logistics.

SUMMARY

This disclosure presents, in accordance with one or more embodiments methods and systems for lining a tubular of a well. The method includes assembling a liner system by disposing a fiber optic cable circumferentially around an inner tube liner and locating an outer tube liner around the inner tube liner. The fiber optic cable is located between the inner tube liner and the outer tube liner. The method also includes spooling out the liner system, in a lay-flat state, into a conduit of a tubular structure positioned in the well, terminating spooling out the liner system when a select length of the liner system has been deployed in the conduit of the tubular structure, and securing the select length of the liner system deployed into the tubular structure at a surface above the well. The method further includes injecting a fluid into the inner tube liner of the liner system to radially expand the liner system to conform an outer circumferential surface of the outer tube liner to an inner circumferential surface of the tubular structure, protecting the inner circumferential surface of the tubular structure using the liner system, and measuring a property of the well using the fiber optic cable.

The system includes a liner system, a tubular structure, a spool, and a fluid. The liner system comprises an inner tube liner, a fiber optic cable configured to measure a property of the well, and an outer tube liner. The inner tube liner is disposed within the outer tube liner and the fiber optic cable is connected to the inner tube liner between the inner tube liner and the outer tube liner. The tubular structure has a conduit and is positioned in the well. The spool is connected to the tubular structure and configured to spool the liner system, in a lay-flat state, into the conduit of the tubular structure. The fluid is configured to be pumped into the inner tube liner of the liner system to radially expand the liner system to conform an outer circumferential surface of the outer tube liner to an inner circumferential surface of the tubular structure.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
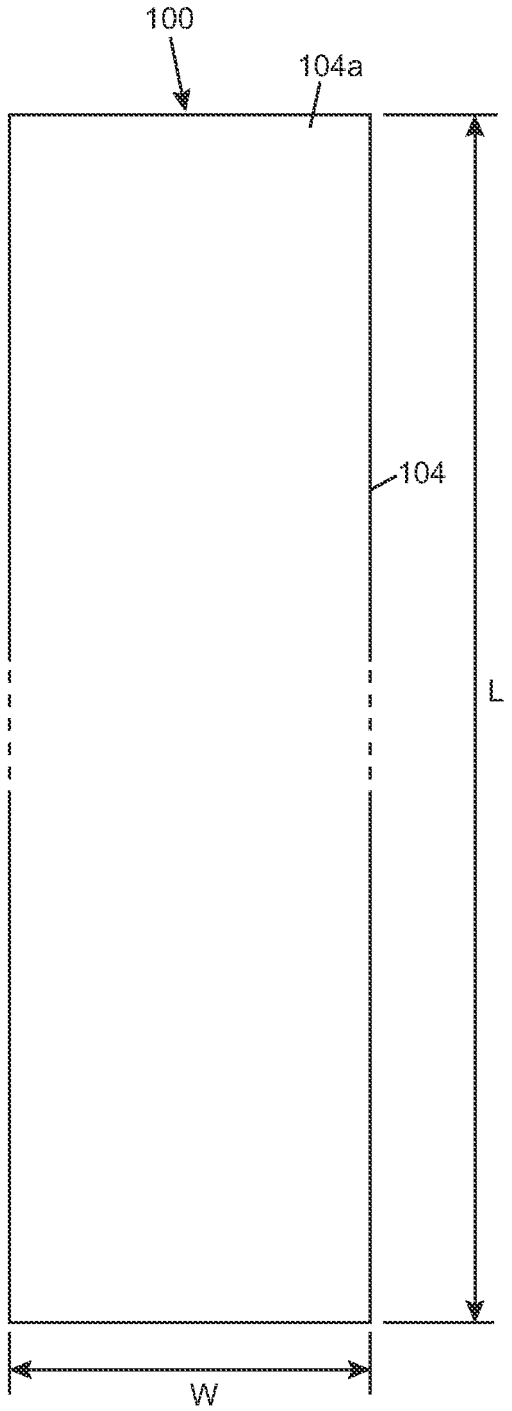
FIG. 1 is an elevation view of a tube liner in a lay-flat state.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the hydrocarbon production systems have not been shown or described in detail to avoid unnecessarily obscuring descriptions of the implementations and embodiments.

For the sake of continuity, and in the interest of conciseness, same or similar reference characters may be used for same or similar objects in multiple figures.

Figure 2:
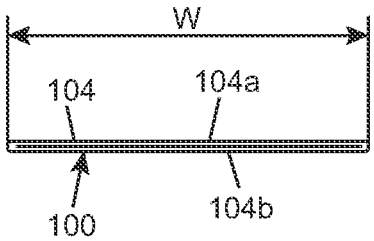
FIG. 2 is an end view of the tube liner of FIG. 1 in a lay-flat state.
Figure 3:
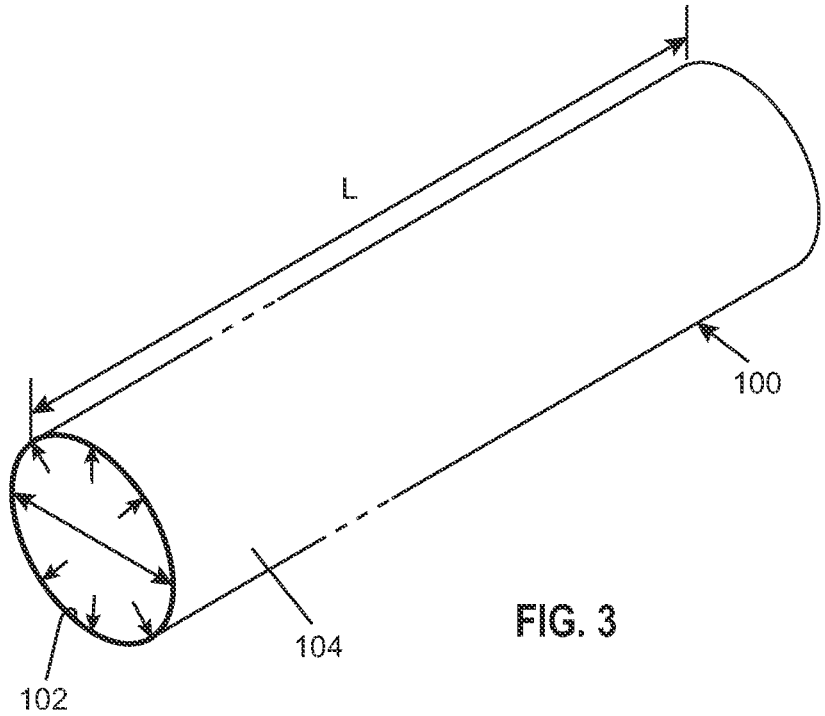
FIG. 3 is a perspective view of the tube liner of FIG. 1 in a round state.

FIGS. 1 and 2 show a tube liner 100 to be used in lining at least a portion of a conduit in a well according to one illustrative implementation. The conduit may run from the bottom of the well to the surface. The conduit may be provided by one or more tubular structures in the well ("tubular well structures"). Examples of tubular well structures are tubulars, such as casings, installed in the well and an open hole section of the well. Tube liner 100 is a lay-flat tubing that can be radially expanded, or transformed, from a lay-flat state to a round state. Tube liner 100 can be deployed into a tubular structure in the lay-flat state and then radially expanded to conform to a wall surface of the tubular structure by fluid pressure, thereby lining the tubular structure. In the lay-flat state of tube liner 100 shown in FIGS. 1 and 2, tube liner 100 does not define a conduit. FIG. 3 shows tube liner 100 radially expanded to a round state. The radial expansion is achieved by applying fluid pressure to an inner surface 102 of a wall 104 of tube liner 100, as shown by the radial arrows in FIG. 3. In the round state, tube liner 100 defines a conduit. In the example of FIG. 3, the conduit has a circular cross-section. However, the conduit may have other shapes depending on the shape of the wall surface to which tube liner 100 is conformed by fluid pressure in the round state.

In one example, tube liner 100 is a lay-flat tubing made of a film material. Because the tube liner is made of a film material, the tube liner is not self-supporting. By not self-supporting, we mean that the tube liner is not rigid along its axial axis and is not rigid in the radial direction (i.e., a direction perpendicular to the axial axis). As a result, if the tube liner is placed on its side, the tube liner will collapse into a flattened state, which is the lay-flat state. Likewise, if the tube liner is placed on its end, the tube liner will collapse into a heap. In one example, a thickness of the film material may be in a range from 0.25 mil (0.00635 mm) to 10 mil (0.245 mm). In another example, a thickness of the film material may be in a range from 0.25 mil (0.00635 mm) to 5 mil (0.127 mm). In yet another example, a thickness of the film material may be in a range from 0.25 mil (0.00635 mm) to 2 mil (0.0508 mm). Preferably, the film material is a strong material that does not tear easily despite being very thin. Preferably, the film material is resistant, i.e., is not easily degraded, by acids and alkalis, such as could be encountered in a well environment. In one example, the film material is made of a thermoplastic polymer. Examples of suitable thermoplastic polymers for the film material include, but are not limited to, polyamides, such as nylon, and polyethylene terephthalate (PET). Preferably the film material can withstand high temperatures, such as temperatures that could be encountered downhole in a well, e.g., temperatures in a range from 70° C. to 120° C. The tube liner may be made by extrusion of molten material between a shaped ring or other suitable process known in the art for making a tubular shape from a film material.

In another example, tube liner 100 may be a lay-flat tubing made of a flexible fiber-reinforced thermoplastic material. The fiber and thermoplastic are in a single layer. Such material can be found in manufacture of lay-flat hose. One example of a lay-flat hose that may serve as lay-flat tubing is manufactured by extruding a thermoplastic material, such as thermoplastic polyether based polyurethane (TPU), through a cylindrical woven jacket made from high tenacity filament polymer reinforcement. A wall thickness of this flexible composite material may be around 4 mm, with a temperature rating of about 70° C. In one example, for downhole use, the flexible fiber-reinforced thermoplastic material of tube liner 100 may have a temperature rating of at least 70° C.

Wall 104 of tube liner 100 has a length L (in FIGS. 1 and 3) that can be selected based on the length of the tubular wall surface to be lined. For example, the length L may be selected to be sufficient to fully line the entire length of the tubular wall surface or to line just a portion of the length of the tubular wall surface that is to be protected from corrosion. For example, the length of tube liner 100 may be at least 50%, more preferably at least 75%, of the length of a tubular wall surface to be lined. In the lay-flat state of tube liner 100, an upper portion 104*a* (in FIGS. 1 and 2) of wall 104 is flat and in opposing relation to and collapsed against a lower portion 104*b* (in FIG. 2) of wall 104 that is also flat—the terms "upper" and "lower" are relative to the orientation of tube liner 100 in FIG. 2. In the lay-flat state, tube liner 100 has a width W (in FIGS. 1 and 2). Tube liner 100 can be radially expanded, as shown in FIG. 3, up to a full diameter d without stretching the material of the tube liner. The relationship between the unstretched full diameter d of tube liner 100 and width W of tube liner 100 is given by:

$$W = \frac{\pi d}{2} \tag{1}$$

To line a tubular wall surface of a tubular well structure, tube liner 100 is deployed in a lay-flat state into the tubular well structure. Once a sufficient length of tube liner 100 has been deployed into the tubular well structure, tube liner 100 is then radially expanded by fluid pressure to conform wall 104 of tube liner 100 to the tubular wall surface of the tubular well structure. In one implementation, particularly if tube liner 100 is made of film material, the unstretched full diameter d (in FIG. 3) can be selected to be slightly larger than the inner diameter of the tubular well structure that is to be lined to avoid stretching the material of tube liner 100 under fluid pressure. If there are multiple inner diameters in the tubular well structure to be lined, the unstretched full diameter d of tube liner 100 can be selected to be slightly larger than the largest inner diameter of the tubular well structure. If the inner diameter (or largest inner diameter) of the tubular well structure that is to be lined is D, then:

$$d = \frac{2W}{\pi} > D \tag{2}$$

Figure 4:
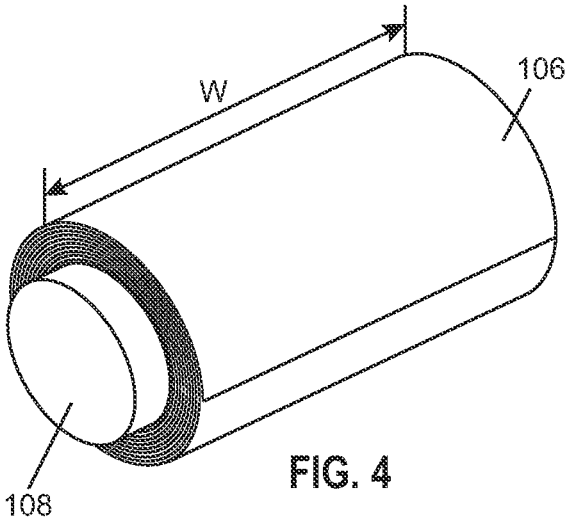
FIG. 4 is a perspective view of a continuous lay-flat tubing on a spool.
Figure 5:
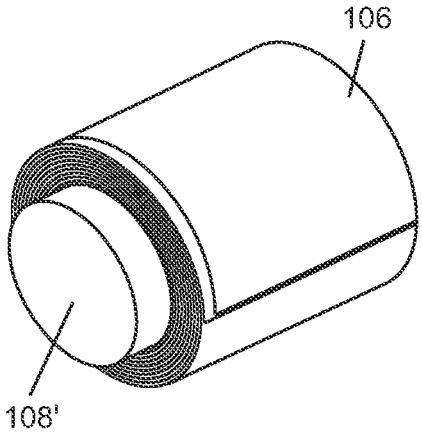
FIG. 5 is a perspective view of the continuous lay-flat tubing of FIG. 4 folded lengthwise on a spool.

FIG. 4 shows a continuous lay-flat tubing 106 wound on a spool or reel 108 in the lay-flat state. Tubing 106 is made of the same material as tube liner 100. Tube liner 100 can be a cut length (or at least a portion) of tubing 106. FIG. 5 shows that tubing 106 in the lay-flat state can be folded lengthwise, for example, to allow a shorter spool or reel 108' to be used to support tubing 106.

Figure 6:
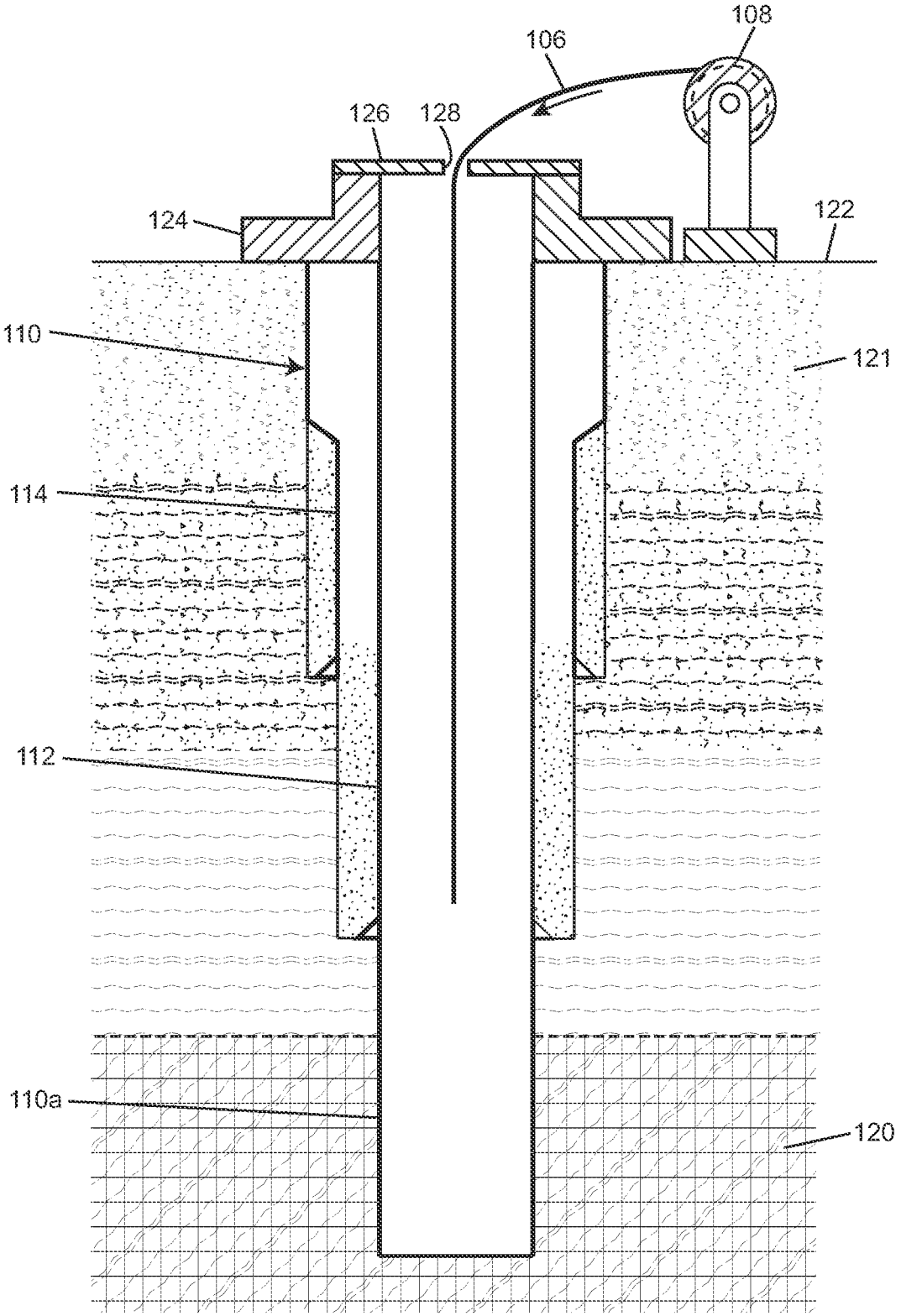
FIG. 6 is a schematic diagram of a system showing the continuous lay-flat tubing of FIG. 4 being deployed into a tubular structure in a well.
Figure 7:
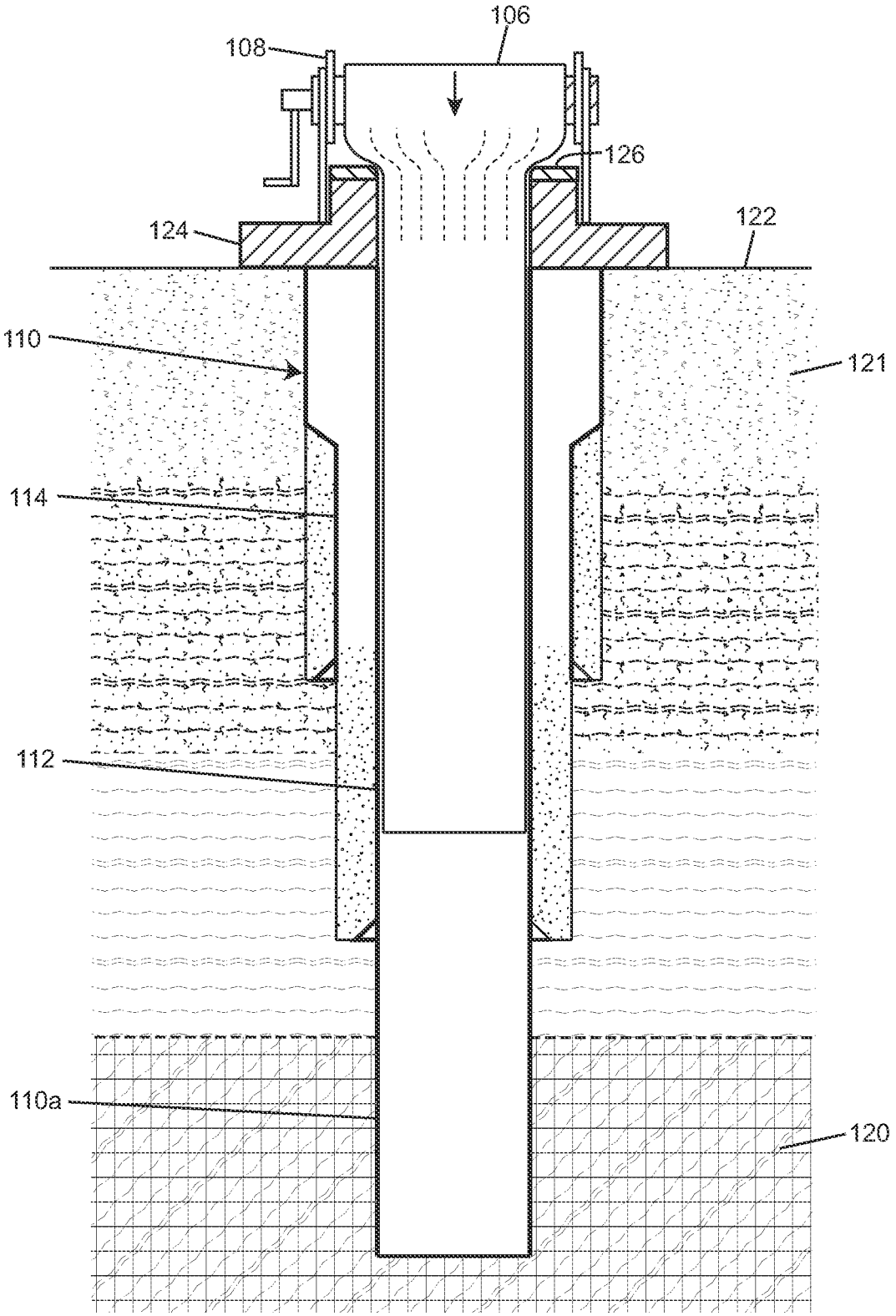
FIG. 7 is a schematic diagram showing another view of the system of FIG. 6.
Figure 8:
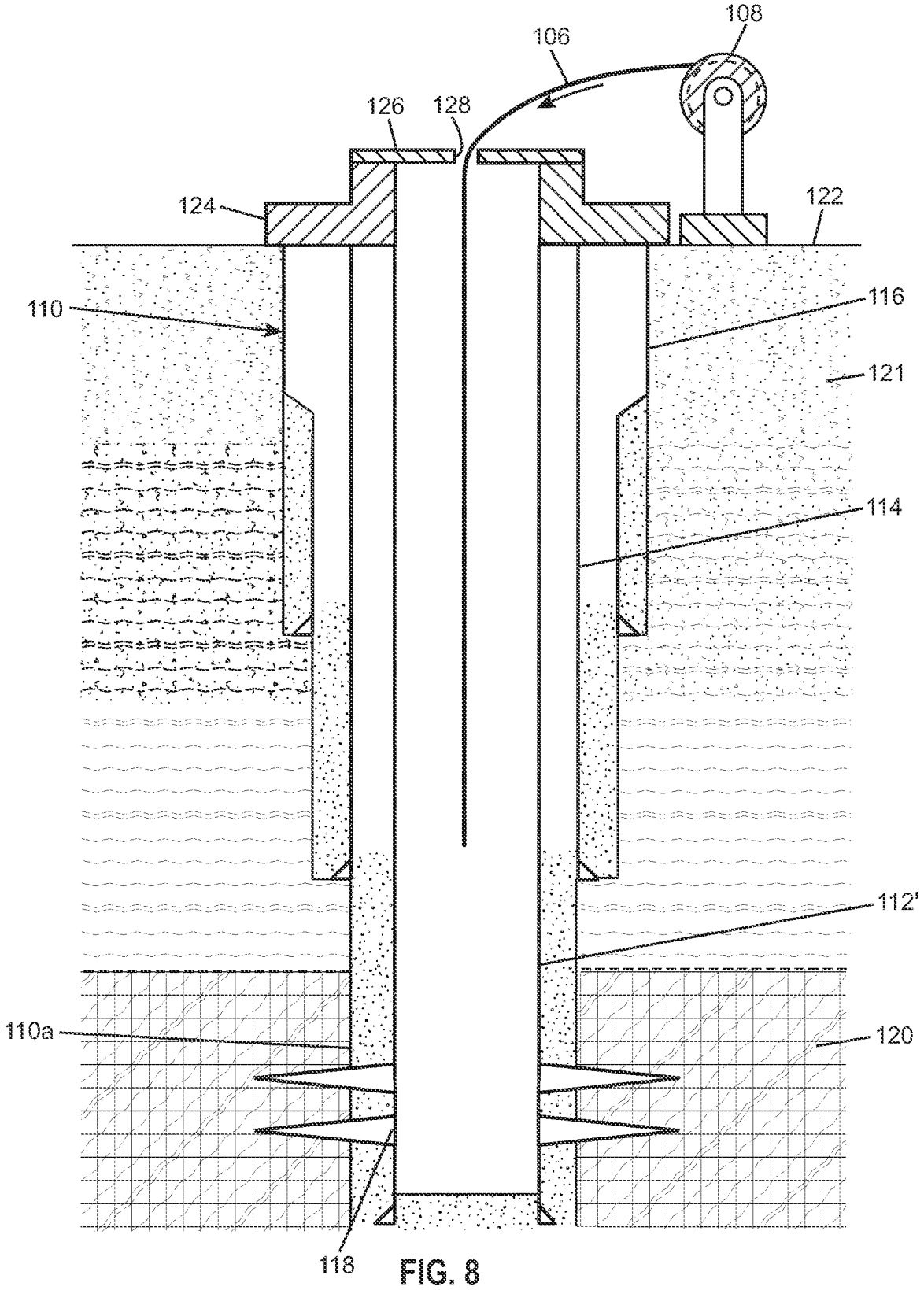
FIG. 8 is a schematic diagram of a system showing the continuous lay-flat tubing of FIG. 4 being deployed into a tubular structure in a well, where the tubular structure is a casing having perforations.

FIGS. 6 and 7 show a well 110 traversing subsurface formations 121 below a surface 122. Well 110 penetrates an injection zone 120 below subsurface formations 121. Casings 112, 114 are installed in well 110 in a generally concentric arrangement (the number of casings shown are merely for illustrative purposes). Casings 112, 114 are examples of tubulars in a well. In FIGS. 6 and 7, well 110 includes an open hole section 110*a* within injection zone 120 and below innermost casing 112. In this case, the tubular structure to be lined may be only innermost casing 112 or innermost casing 112 and a portion of open hole section 110*a*. Preferably, all of open hole section 110*a* is not lined in order to permit fluid communication with injection zone 120 through well 110. FIG. 8 shows an alternative example where casings 112', 114, 116 are installed in well 110, and innermost casing 112' extends into injection zone 120. In this case, casing 112' may have perforations 118 for fluid communication with injection zone 120. In this case, the tubular structure to be lined may be innermost casing 112'. Preferably, the lining does not cover perforations 118 in order to permit fluid communication with injection zone 120 through well 110 after the lining operation.

Returning to FIGS. 6 and 7, spool 108 with continuous lay-flat tubing 106 is positioned at surface 122. Tubing 106 is being fed through a wellhead 124 at surface 122 into innermost casing 112, which is part of the tubular structure to be lined in this example (in the example shown in FIG. 8, tubing 106 is fed into innermost casing 112'). A guide plate 126 may be arranged on wellhead 124 to guide feeding of continuous tubing 106 into casing 112 (112' in FIG. 8). Guide plate 126 may have a slot 128 to receive tubing 106.

Figure 9:
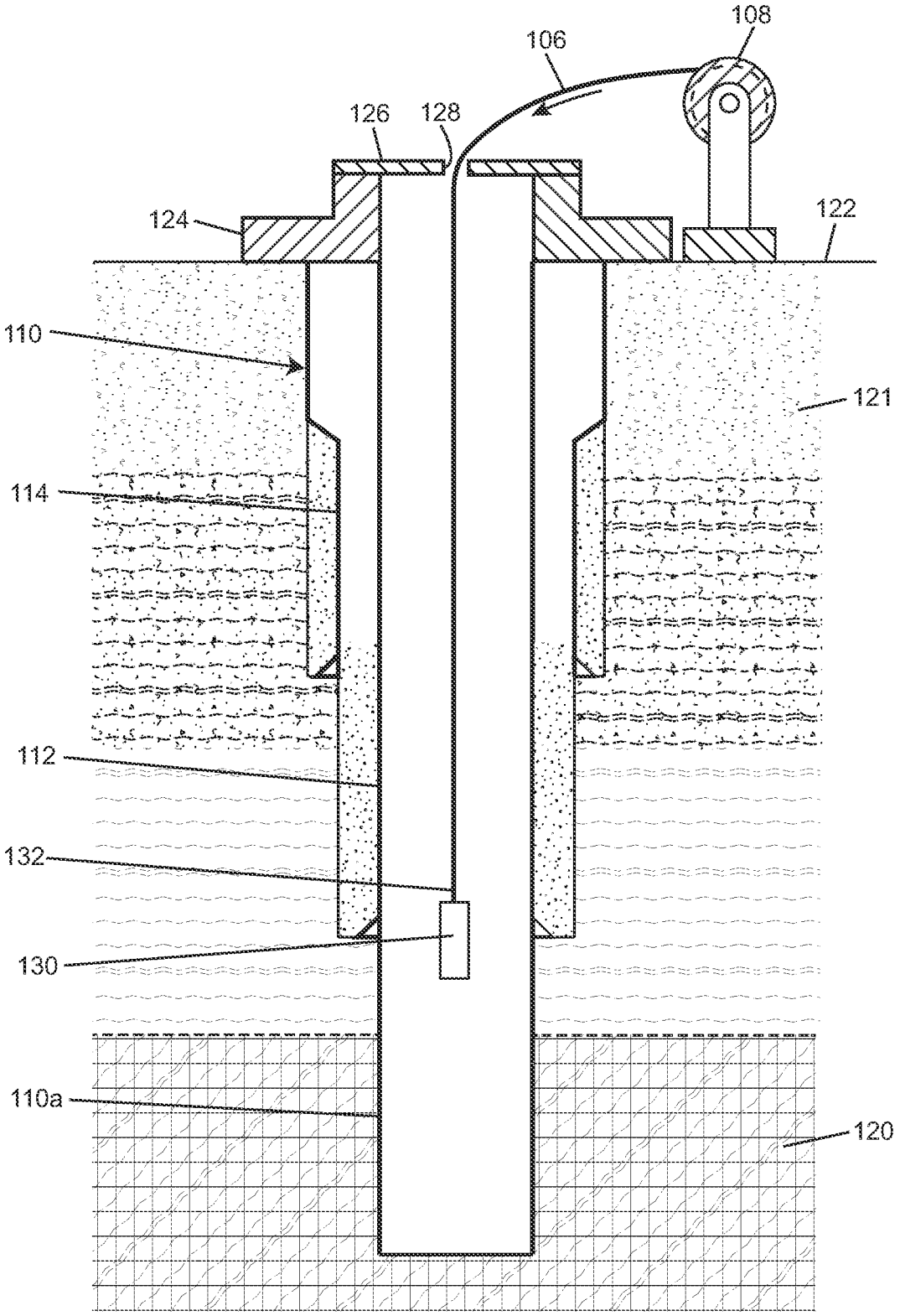
FIG. 9 is a schematic diagram showing a dissolvable weight attached to a leading end of the continuous lay-flat tube of FIG. 6.

In some cases, as illustrated in FIG. 9, a dissolvable weight 130 may be attached, e.g., by means of adhesive, to a leading end 132 of continuous lay-flat tubing 106, and the weight of dissolvable weight 130 may pull tubing 106 into casing 112 from spool 108. The dissolvable weight 130 may be a material that is soluble in water or brine. In one non-limiting example, dissolvable weight 130 may be a magnesium alloy that is dissolvable in brine.

Figure 10:
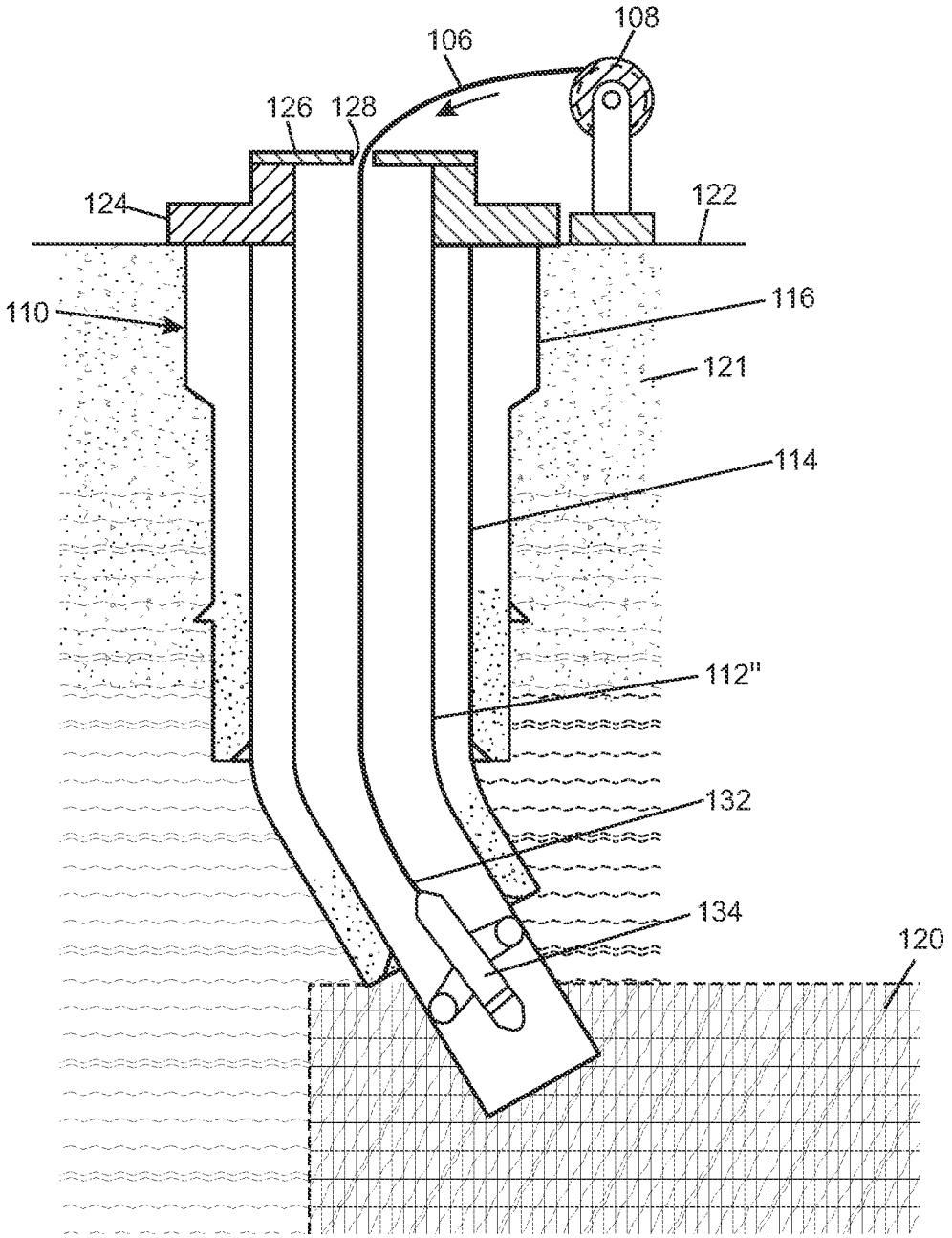
FIG. 10 is a schematic diagram showing a downhole tractor pulling a continuous lay-flat tube along a tubular structure in a deviated well.

If the tubular structure to be lined is in an inclined or highly deviated well, a downhole tractor may be used to pull continuous lay-flat tubing 106 into the tubular structure. For illustrative purposes, FIG. 10 shows a casing 112" in a deviated portion of a well. The leading end 132 of tubing 106 is attached to a downhole tractor 134, which is then operated to pull tubing 106 along the casing 112". A downhole tractor typically includes wheels to ride along the surface of the tubular and a drive section to propel the tractor. In general, any suitable downhole tractor, such as downhole tractors used to pull coiled tubing or other downhole equipment, may be used as downhole tractor 134. After downhole tractor 134 has reached the end of casing 112", downhole tractor 134 may be operated to release leading end 132 of tubing 106. Downhole tractor 134 may be returned to the surface in a subsequent operation.

Figure 11:
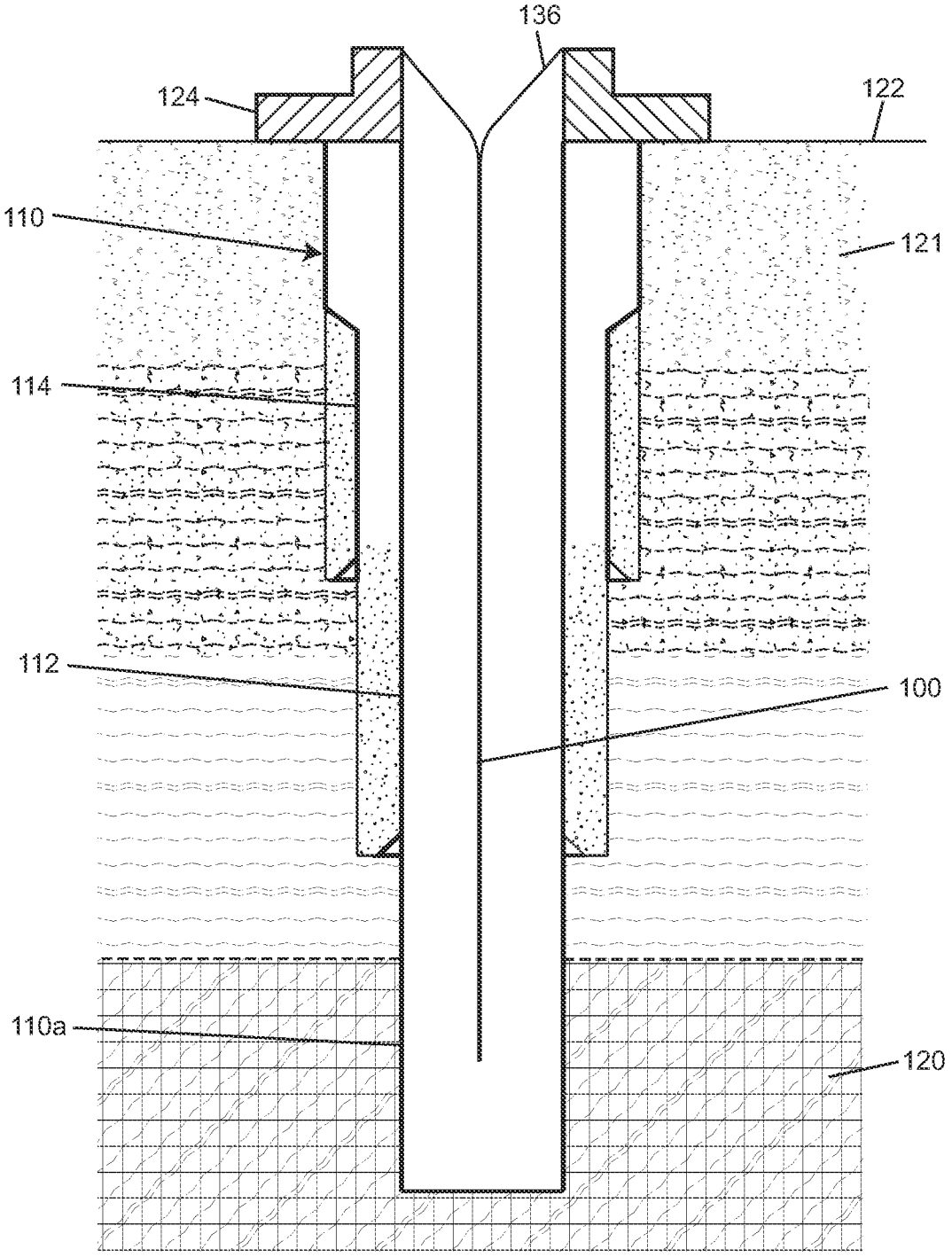
FIG. 11 is a schematic diagram showing a cut portion of the continuous lay-flat tubing of FIGS. 6 and 7 secured to a wellhead.

Returning to FIGS. 6 and 7, when a sufficient length of continuous lay-flat tubing 106 has been deployed into casing 112 (112' in FIG. 8), tubing 106 can be cut at wellhead 124 to terminate the spooling out of the tubing 106, leaving the desired length of tubing 106 inside casing 112 as tube liner 100. As shown in FIG. 11, the cut end 136 of the portion of tubing 106 in well 110, which is now tube liner 100, can be secured to wellhead 124 using any suitable method.

Figure 12:
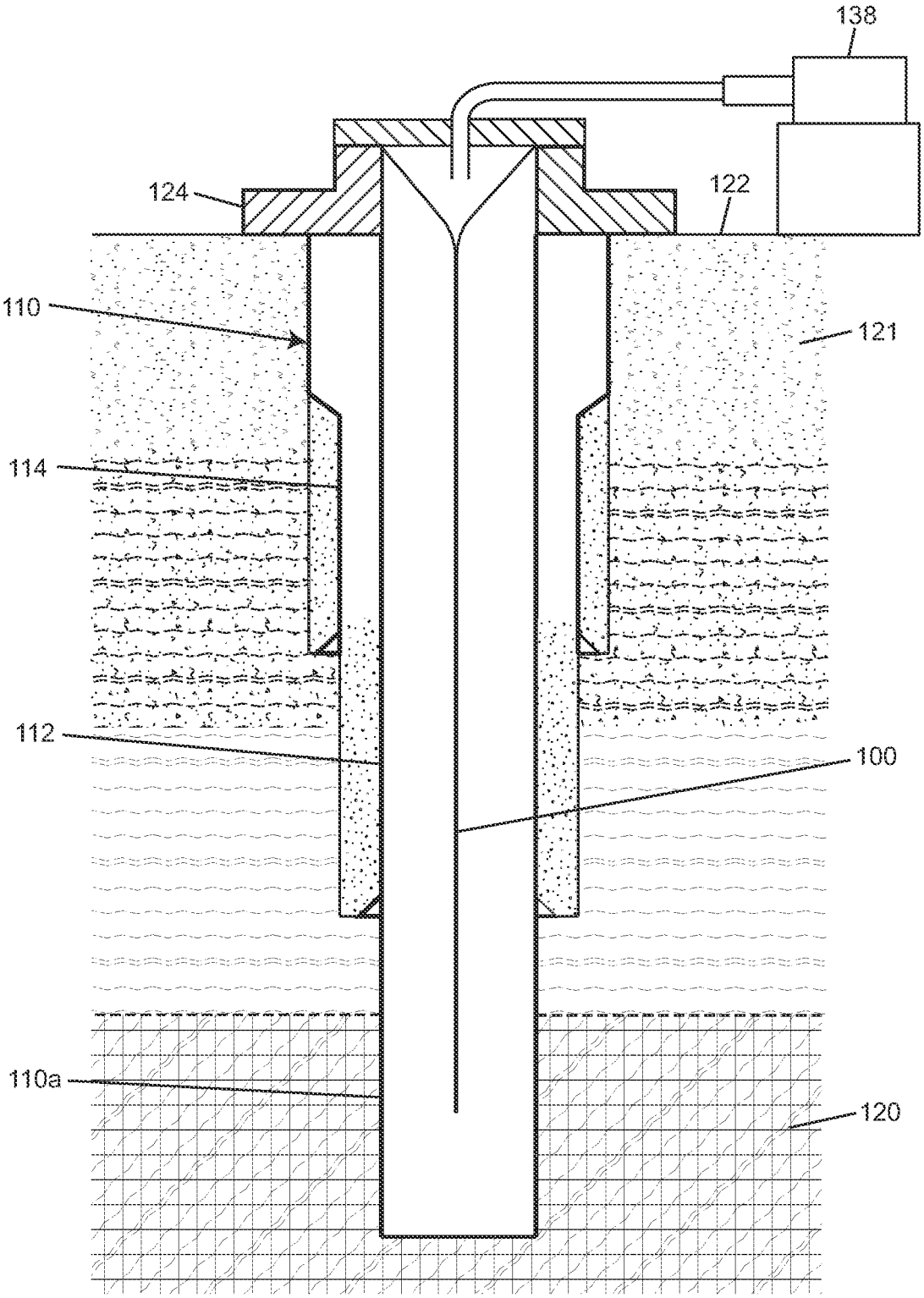
FIG. 12 is a schematic diagram showing a pump arranged to pump fluid into a tube liner deployed into a tubular structure in a well.
Figure 13:
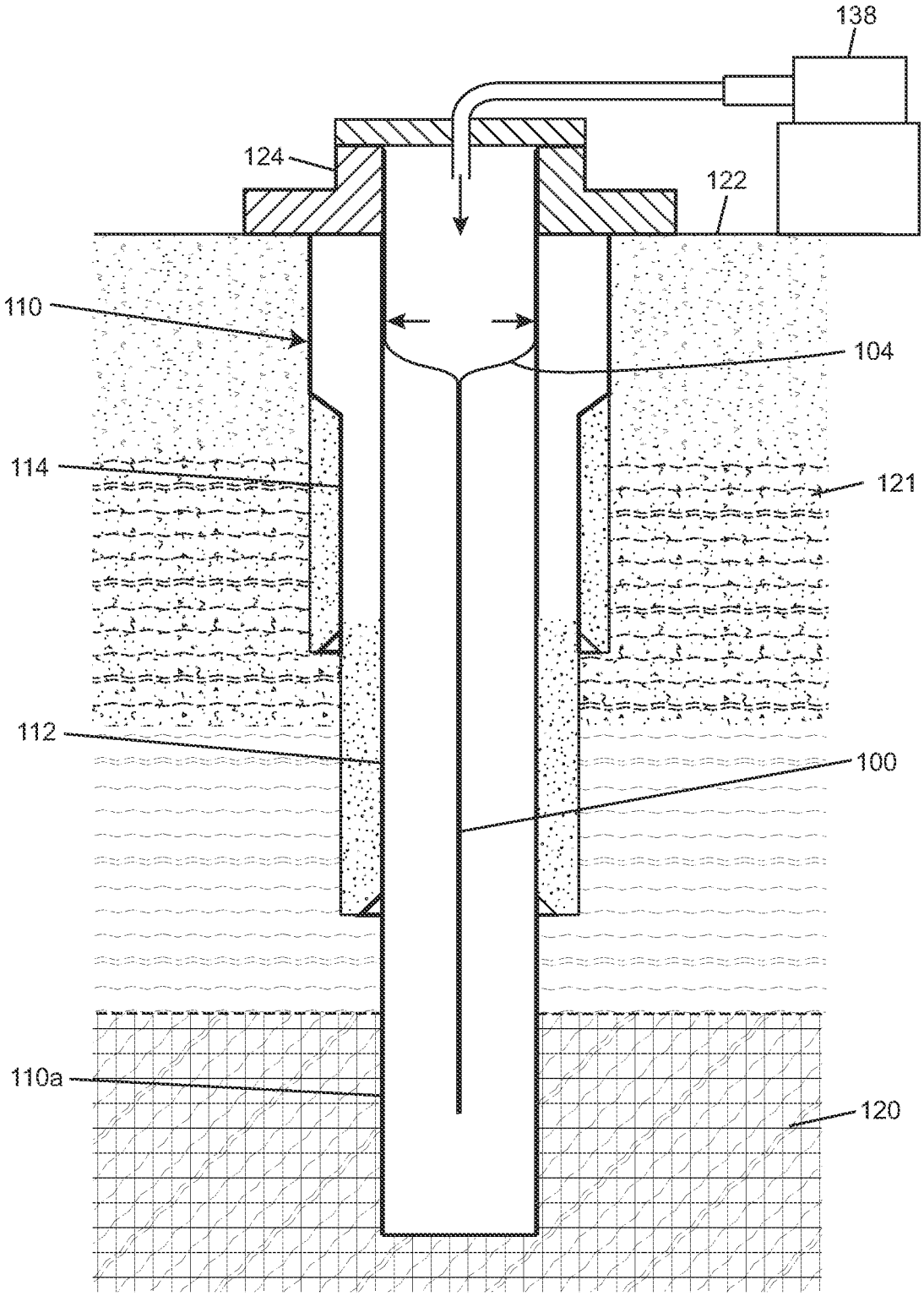
FIG. 13 is a schematic diagram showing fluid pressure pushing a wall of the tube liner of FIG. 11 towards a wall surface of the tubular structure.
Figure 14:
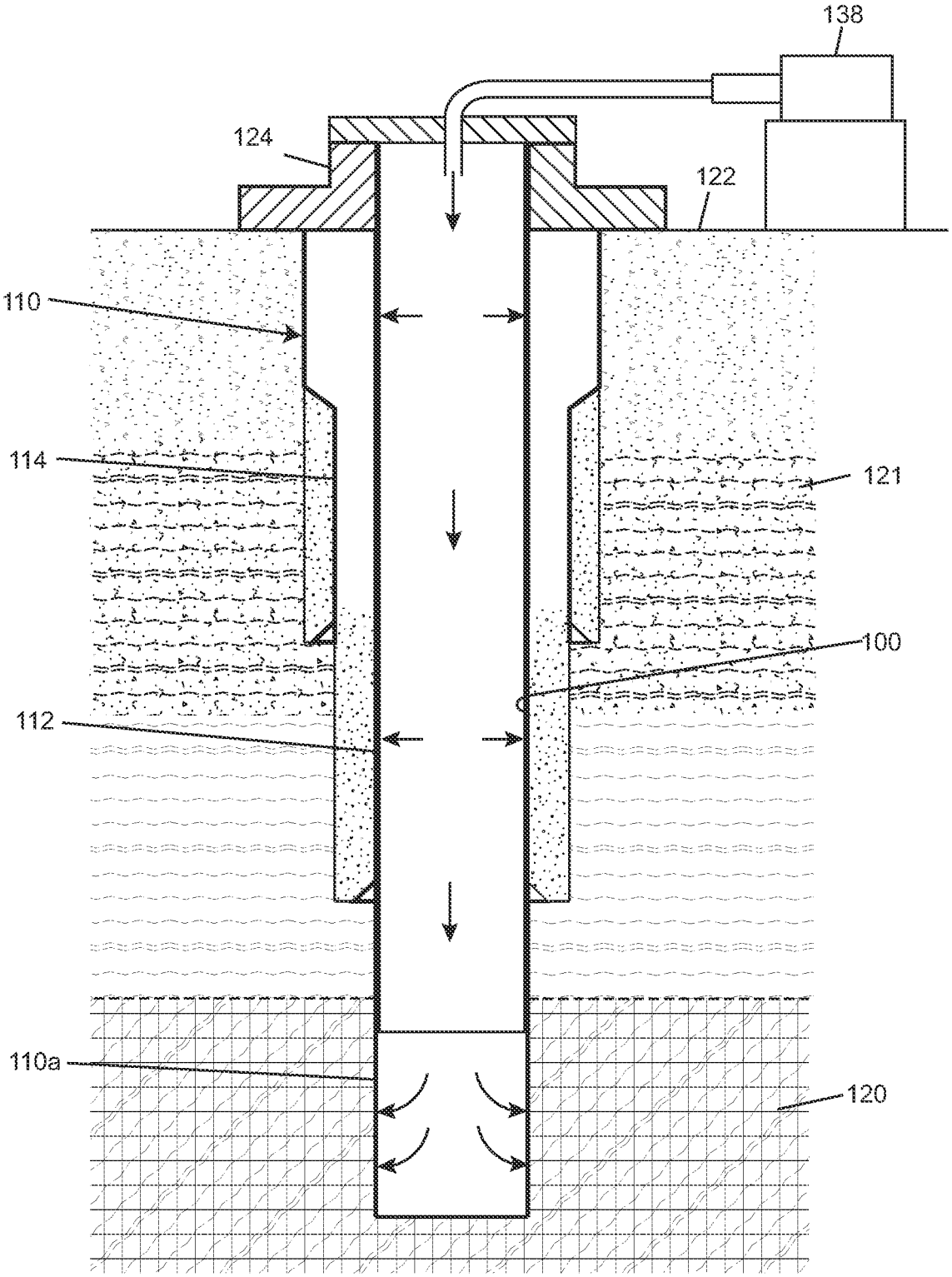
FIG. 14 is a schematic diagram showing the full length of tube liner of FIG. 12 expanded to conform to the tubular structure.

FIG. 12 shows a pump 138 arranged at surface 122 to pump fluid into tube liner 100. The fluid may be water, brine, or seawater, for example. FIG. 13 shows the fluid pressure pushing wall 104 of tube liner 100 towards the inner wall surface of casing 112 as fluid is pumped down tube liner 100. FIG. 14 shows the full length of tube liner 100 expanded to conform to the inner wall surface of casing 112, thereby lining casing 112. As long as there is fluid pressure acting on tube liner 100 from the inside of tube liner 100, tube liner 100 will conform to the inner surface of casing 112. (When fluid pressure is removed from tube liner 100, tube liner 100 may cling to casing 112. However, tube liner 100 may eventually fall away from casing 112 without the fluid pressure to conform tube liner 100 to casing 112.) In the illustrated example, tube liner 100 covers a portion of open hole section 110*a*. However, in other examples, tube liner 100 may not cover any portion of open hole section 110*a*.

The well lining method and system described may provide advantages. Tube liner 100 can be easily installed inside a tubular structure, such as casing 112, in a well without complicated equipment. When tube liner 100 conforms to a tubular wall surface of the tubular structure in the well, tube liner 100 protects the tubular wall surface from corrosive fluids while providing a conduit for flow of fluid between the well and the surface. This eliminates the need to install a separate tubing inside the tubular structure for passage of fluids that may be corrosive. Tube liner 100 can be made of relatively inexpensive material. Tube liner 100 can be installed in a tubular that is already in a well, which removes the complicated logistics for lining the tubular in the shop prior to installing the tubular in the well.

The system shown in FIG. 14 may be used as an injection well. An injection well is a device that places fluid deep underground into porous rock formations. The fluid may be water, brine, or water mixed with chemicals. For example, chemicals may be added to water to increase the viscosity and/or salinity of the water. In the oil and gas industry, water injection (also known as water flooding) is used to enhance oil recovery from a producing well. Water injection involves introducing water into the reservoir to encourage oil production. The injected water helps with the depleted pressure within the reservoir and also helps to move the oil in place. In one implementation, a water injection operation may involve lining a tubular structure, e.g., casing 112, in a well with tube liner 100 as described and then using the conduit provided by tube liner 100 to convey fluid to the injection zone, e.g., injection zone 120. Pump 138 may provide the fluid that is conveyed to injection zone 120.

Figure 15:
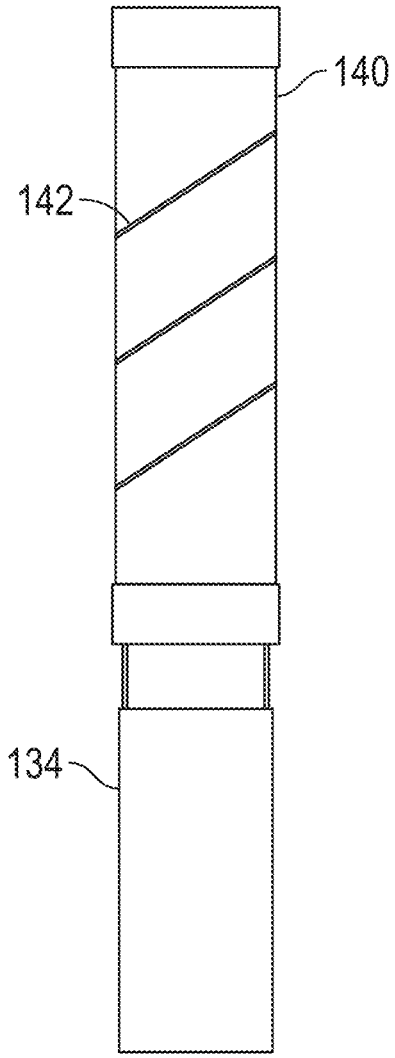
FIG. 15 is an elevation view of an inner tube liner connected to a tractor in accordance with one or more embodiments.
Figure 16:
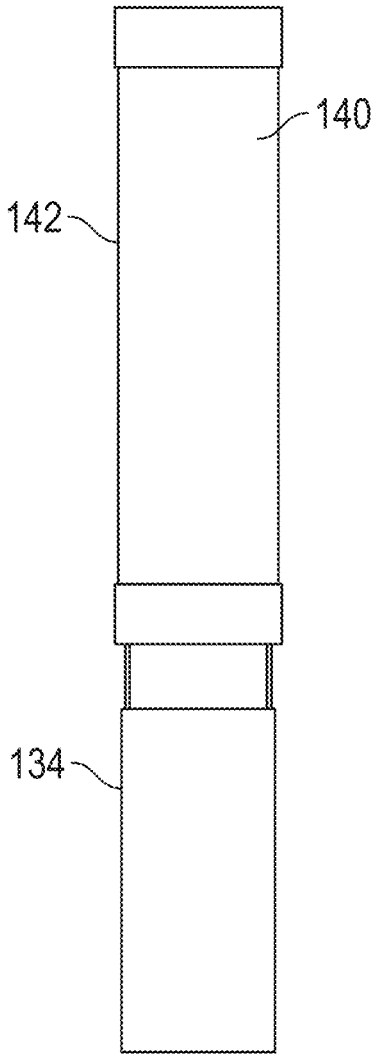
FIG. 16 is an elevation view of an inner tube liner connected to a tractor in accordance with one or more embodiments.

FIGS. 15 and 16 show elevation views of an inner tube liner 140 connected to a tractor 134 in accordance with one or more embodiments. The inner tube liner 140 has the same function and description as the tube liner 100/tubing 106 outlined above with respect to FIGS. 1-14. Components shown in FIGS. 15 and 16 that are the same as or similar to components shown above have not been redescribed for purposes of readability and have the same description and function as outlined above.

A fiber optic cable 142 is disposed on an outer circumferential surface of the inner tube liner 140. The fiber optic cable 142 may include one or more fiber optic cables. The fiber optic cable 142 may be disposed around the outer circumferential surface of the inner tube liner 140 in any placement configuration.

For example, as shown in FIG. 15, the fiber optic cable 142 is wrapped around the outer circumferential surface of the inner tube liner 140 in a spiral shape. In accordance with other embodiments and as shown in FIG. 16, the fiber optic cable 142 may extend in a straight line running along the length of the outer circumferential surface of the inner tube liner 140. In further embodiments, more than one fiber optic cable may be connected to or wrapped around the outer circumferential surface of the inner tube liner 140 without departing from the scope of the disclosure herein.

In accordance with one or more embodiments, the outer circumferential surface of the inner tube liner 140 is coated with thermoplastic or epoxy in order to fix the fiber optic cable and an outer tube liner 144 to the outer circumferential surface of the inner tube liner 140. The outer tube liner 144 is further outlined in FIGS. 17 and 18 below.

Figure 17:
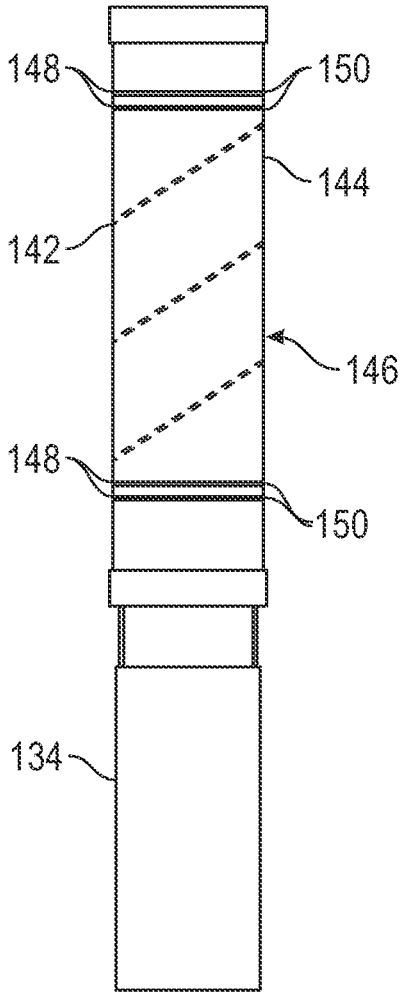
FIG. 17 is an elevation view of a liner system connected to a tractor in accordance with one or more embodiments.
Figure 18:
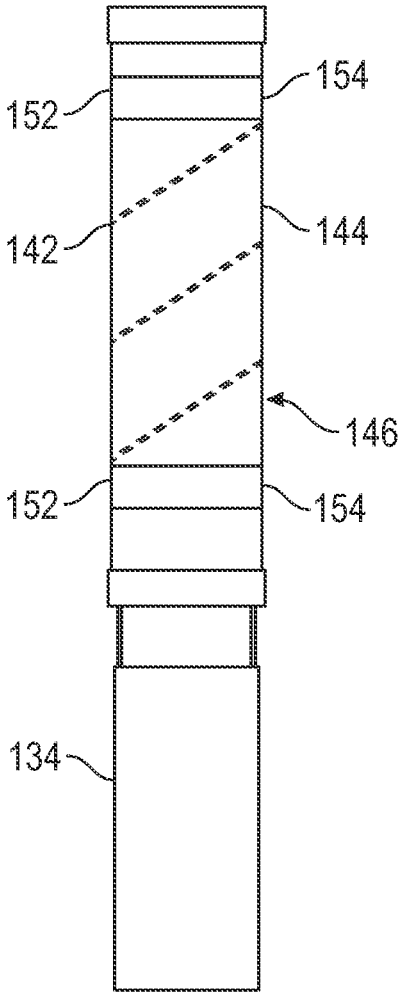
FIG. 18 is an elevation view of a liner system connected to a tractor in accordance with one or more embodiments.

FIGS. 17 and 18 show elevation views of a liner system 146 connected to a tractor 134 in accordance with one or more embodiments. The liner system 146 is made of an inner tube liner 140, a fiber optic cable 142, and an outer tube liner 144. Components shown in FIGS. 17 and 18 that are the same as or similar to components shown above have not been redescribed for purposes of readability and have the same description and function as outlined above.

The inner tube liner 140 and the outer tube liner 144 have the same description and function as outlined above with respect to the tube liner 100/tubing 106. The difference between the inner tube liner 140 and the outer tube liner 144 is the placement of one within the other. Specifically, the inner tube liner 140 is disposed inside of the outer tube liner 144. That is, the outer circumferential surface of the inner tube liner 140 is connected to the inner circumferential surface of the outer tube liner 144. Furthermore, the fiber optic cable 142 is disposed between the outer circumferential surface of the inner tube liner 140 and the inner circumferential surface of the outer tube liner 144.

As outlined above in FIGS. 15 and 16, the inner tube liner 140 is coated with thermoplastic or epoxy in order to fix the fiber optic cable and an outer tube liner 144 to the outer circumferential surface of the inner tube liner 140. The outer tube liner 144 is used to protect the fiber optic cable 142 from interaction with any fluid, such as the fluid used to expand the liner system 146 in the casing 112 or the production fluid that flows through the lined casing 112.

Due to the isolation of the fiber optic cable 142, the fiber optic cable 142 has the ability to detect a leak in the inner tube liner 140. That is, if the fiber optic cable 142 senses a fluid, then there must be a leak in the inner tube liner 140 allowing the fluid to enter the liner system 146. The fiber optic cable 142 may also be used in conjunction with sensors to measure well 110 characteristics and properties. The sensors may be disposed along the fiber optic cable 142 between the outer tube liner 144 and the inner tube liner 140.

FIG. 17 shows the outer tube liner 144 having a thermoplastic slot 148 filled with a thermoplastic 150. The thermoplastic slot 148 is disposed circumferentially around the outer circumferential surface of the outer tube liner 144. In accordance with one or more embodiments, the thermoplastic slot 148 may be formed in the outer circumferential surface of the outer tube liner 144. The thermoplastic 150 is used to enhance the liner system 146 as the liner system 146 is deployed in a well 110, as outlined above in FIGS. 1-14. Specifically, the thermoplastic 150 may reduce the friction between the outer circumferential surface of the outer tube liner 144 and the inner circumferential surface of the casing, thus enabling the liner system 146 to be deployed into the casing 112.

FIG. 17 shows four thermoplastic slots 148 filled with thermoplastic 150, however, any number of thermoplastic slots 148 filled with thermoplastic 150 may be used without departing from the scope of the disclosure herein. The number and location of thermoplastic slots 148 filled with thermoplastic 150 may be determined based on the amount of friction that needs to be reduced in order to effectively run the liner system 146 into the casing 112.

FIG. 18 shows the outer tube liner 144 having a tape slot 152. A magnetic tape is disposed within the tape slot 152. The tape slot 152 is disposed circumferentially around the outer circumferential surface of the outer tube liner 144. In accordance with one or more embodiments, the tape slot 152 may be formed in the outer circumferential surface of the outer tube liner 144. The magnetic tape 154 has magnetic properties to enable a magnetic connection to occur between the magnetic tape 154 and the inner circumferential surface of the casing 112. This magnetic connection allows the liner system 146 to connect to the inner circumferential surface of the casing 112.

FIG. 18 shows two tape slots 152 filled with magnetic tape 154, however, any number of tape slots 152 filled with magnetic tape 154 may be used without departing from the scope of the disclosure herein. The number and location of tape slots 152 filled with magnetic tape 154 may be determined based on the length of the liner system 146. Furthermore, while not pictured, a person of ordinary skill in the art will appreciate that the outer tube liner may have both thermoplastic 150 and magnetic tape 154 disposed therein.

The liner system 146 shown in FIGS. 15-18 is shown connected to a tractor 134. The tractor 134 may be connected to the liner system 146 using any means known in the art, such as wires, cables, adhered together, etc. Furthermore, while FIGS. 15-18 only show a tractor 134 connected to the liner system 146, a dissolvable weight 130 may also be connected to the liner system 146 as outlined above in this disclosure.

The liner system 146 as described above may be installed within a well 110 using any of the systems and methods outlined above. Specifically, and in accordance with one or more embodiments, the liner system 146 is assembled and placed in a lay-flat state. In the lay-flat state, the liner system 146 is wrapped around a spool 108. The spool 108 spools the liner system 146 in the lay-flat state into a conduit of a tubular of a well 110, such as a casing 112.

The dissolvable weight 130 or tractor 134 may be used to lower or pull, respectively, the liner system 146 to a predetermined depth in the tubular. In further embodiments, the liner system 146 in the lay flat state may be deployed into the tubular through a slot 128 in a guide plate 126 capping the opening to the tubular. The slot 128 is centered on the opening such that the liner system 146 in the lay flat state has minimal interaction with the walls of the tubular as the liner system 146 is lowered into the tubular.

Once the liner system 146 is at the predetermined depth, a fluid is pumped into the inside of the inner tube liner 140. The pressure of the fluid expands the liner system 146 into the inner wall of the tubular. The outer circumferential surface of the outer tube liner 144 adheres to the inner wall of the tubular and the liner system 146 is installed within the well 110.

While the invention has been described with respect to a limited number of embodiments, those skilled in the art, having the benefit of this disclosure, will appreciate that other embodiments can be devised that do not depart from the scope of the invention as described herein. Accordingly, the scope of the invention should be limited only by the accompanying claims.

What is claimed is:

1. A method for a well, the method comprising:

assembling a liner system by disposing a fiber optic cable circumferentially around an inner tube liner, locating an outer tube liner around the inner tube liner, and forming a slot in an outer circumferential surface of the outer tube liner, wherein the fiber optic cable is located between the inner tube liner and the outer tube liner;

spooling out the liner system, in a lay-flat state, into a conduit of a tubular structure positioned in the well;

terminating spooling out the liner system when a select length of the liner system has been deployed in the conduit of the tubular structure;

securing the select length of the liner system deployed into the tubular structure at a surface above the well;

injecting a fluid into the inner tube liner of the liner system to radially expand the liner system to conform the outer circumferential surface of the outer tube liner to an inner circumferential surface of the tubular structure;

protecting the inner circumferential surface of the tubular structure using the liner system; and measuring a property of the well using the fiber optic cable.

2. The method of claim 1, wherein assembling the liner system having the lay-flat state comprises selecting the liner system having a full diameter, when the lay flat state is radially expanded into a round state, that is larger than an inner diameter of the tubular structure.

3. The method of claim 1, wherein injecting the fluid into the inner tube liner of the liner system to radially expand the liner system to conform the outer tube liner to an inner circumferential surface of the tubular structure comprises transforming the liner system from the lay-flat state to a round state.

4. The method of claim 1, wherein deploying the liner system having the lay-flat state into the tubular structure comprises coating the outer tube liner with a film material.

5. The method of claim 1, wherein assembling the liner system comprises selecting the inner tube liner and the outer tube liner which are made of a flexible fiber-reinforced thermoplastic material.

6. The method of claim 1, wherein the well penetrates an injection zone, and further comprising conveying fluid into the injection zone by pumping fluid through the conduit of the tubular structure.

7. The method of claim 1, wherein assembling the liner system by forming the slot in the outer circumferential surface of the outer tube liner further comprises forming a thermoplastic slot in the outer circumferential surface of the outer tube liner.

8. The method of claim 7, wherein assembling the liner system by forming the slot in the outer circumferential surface of the outer tube liner further comprises filling the thermoplastic slot with thermoplastic.

9. The method of claim 1, wherein assembling the liner system by forming the slot in the outer circumferential surface of the outer tube liner further comprises forming a tape slot in the outer circumferential surface of the outer tube liner.

10. The method of claim 9, wherein assembling the liner system by forming the slot in the outer circumferential surface of the outer tube liner further comprises installing magnetic tape into the tape slot.

11. A system for a well, the system comprising:

a liner system comprising an inner tube liner, a fiber optic cable configured to measure a property of the well, an outer tube liner, and a slot formed in an outer circumferential surface of the outer tube liner, wherein the inner tube liner is disposed within the outer tube liner and the fiber optic cable is connected to the inner tube liner between the inner tube liner and the outer tube liner;

a tubular structure, having a conduit, positioned in the well;

a spool connected to the tubular structure and configured to spool the liner system, in a lay-flat state, into the conduit of the tubular structure; and a fluid configured to be pumped into the inner tube liner of the liner system to radially expand the liner system to conform the outer circumferential surface of the outer tube liner to an inner circumferential surface of the tubular structure.

12. The system of claim 11, wherein the liner system has a full diameter, when the lay flat state is radially expanded into round state, that is larger than an inner diameter of the tubular structure.

13. The system of claim 11, wherein the liner system is configured to transform from the lay-flat state to a round state when the fluid is pumped into the inner tube liner.

14. The system of claim 11, wherein the outer tube liner is coated in a film material.

15. The system of claim 11, wherein the inner tube liner and the outer tube liner are made of a flexible fiber-reinforced thermoplastic material.

16. The system of claim 11, wherein the well penetrates an injection zone.

17. The system of claim 11, wherein the slot further comprises a thermoplastic slot formed in the outer circumferential surface of the outer tube liner.

18. The system of claim 17, wherein the thermoplastic slot is filled with a thermoplastic.

19. The system of claim 11, wherein slot further comprises a tape slot formed in the outer circumferential surface of the outer tube liner.

20. The system of claim 19, wherein a magnetic tape is installed in the tape slot.

* * * * *